US007938042B2

(12) United States Patent
Hu

(10) Patent No.: US 7,938,042 B2
(45) Date of Patent: May 10, 2011

(54) RATCHET WRENCH WITH THREE OPERATIVE POSITIONS

(76) Inventor: Bobby Hu, Taichung (TW)

( * ) Notice: Subject to any disclaimer, the term of this patent is extended or adjusted under 35 U.S.C. 154(b) by 309 days.

(21) Appl. No.: 12/389,251

(22) Filed: Feb. 19, 2009

(65) Prior Publication Data

US 2009/0301265 A1 Dec. 10, 2009

(30) Foreign Application Priority Data

Jun. 6, 2008 (TW) ..... 97121128 A

(51) Int. Cl.
*B25B 13/46* (2006.01)

(52) U.S. Cl. ..... 81/62

(58) Field of Classification Search ..... 81/61, 62, 81/63.1, 57.39; 192/43.1
See application file for complete search history.

(56) References Cited

U.S. PATENT DOCUMENTS

| | | | | | |
|---|---|---|---|---|---|
| 2,772,763 | A | * | 12/1956 | Johnson | 192/43.1 |
| 3,372,612 | A | * | 3/1968 | Rozmus | 81/62 |
| 3,467,231 | A | * | 9/1969 | Haznar | 192/43.1 |
| 4,445,404 | A | | 5/1984 | Parker | 81/62 |
| 4,491,043 | A | | 1/1985 | Dempsey et al. | 81/58 |
| 4,589,307 | A | | 5/1986 | Parker | 81/62 |
| 4,765,449 | A | * | 8/1988 | Peters | 192/43.1 |
| 5,537,899 | A | * | 7/1996 | Diedrich | 81/57.39 |
| 5,983,757 | A | * | 11/1999 | Blise et al. | 81/57.39 |
| 6,076,433 | A | | 6/2000 | Lynch | 81/63 |
| 6,125,722 | A | | 10/2000 | Hopper et al. | 81/63 |
| 6,209,422 | B1 | * | 4/2001 | Kamiya et al. | 81/57.39 |
| 6,311,584 | B1 | * | 11/2001 | Chu | 81/57.29 |
| 6,457,386 | B1 | * | 10/2002 | Chiang | 81/62 |
| 6,752,048 | B1 | * | 6/2004 | Chiang | 81/63.1 |
| 7,111,527 | B1 | | 9/2006 | Lee | 81/63.1 |

FOREIGN PATENT DOCUMENTS

| | | |
|---|---|---|
| TW | 235541 | 12/1994 |
| TW | 373543 | 11/1999 |
| TW | 399509 | 7/2000 |
| TW | 524174 | 3/2003 |
| TW | 589241 | 6/2004 |

* cited by examiner

*Primary Examiner* — D. S. Meislin
(74) *Attorney, Agent, or Firm* — Alan Kamrath; Kamrath & Associates PA

(57) ABSTRACT

A ratchet wrench includes a head (11) having a through-hole (13) rotatably receiving a drive member (20). Two pawls (30) are pivotably received in two compartments (21) in the drive member (20). Each pawl (30) includes first teeth (31) on a first end (60) thereof and second teeth (32) on a second end (62) thereof. Each pawl (30) includes first second, and third positioning faces (351, 352, 353) on an inner side (64) thereof. A control member (40) is rotatably received in the drive member (20) and movable between first, second, and third operative positions to change the driving direction of the ratchet wrench. The center (C) of the third positioning face (353) of each pawl (30) is not coincident to the center of the inner side (64) of the pawl (30).

11 Claims, 11 Drawing Sheets

RATCHET WRENCH WITH THREE OPERATIVE POSITIONS

BACKGROUND OF THE INVENTION

Field of the Invention

The present invention relates to a ratchet wrench and, more particularly, to a ratchet wrench that includes three operative positions.

Taiwan Patent Publication No. 235541 entitled "IMPROVED RATCHET WRENCH STRUCTURE" discloses a ratchet wrench including two pawls pivotably mounted in a pivotal rod receiving two balls. Each pawl includes an inner side having a groove in a center thereof. The groove of each pawl includes two faces. Each ball is biased to selectively press against one of the faces of one of the pawls. Although such a ratchet wrench can drive fasteners such as bolts, nuts, etc. in one of two operative directions (clockwise and counterclockwise) while allowing free rotation in a reverse direction, the ratchet wrench can not be utilized as a conventional wrench of the type capable of driving fasteners in either direction and not allowing free rotation in the reverse direction, which may be required in some cases. As an example, when it is desired to proceed with slight tightness adjustment of a fastener by rotating the fastener in the tightening direction and/or loosening direction before the desired tightness is obtained, a user has to frequently switch a knob fixed to an end of the pivotal rod between two operative positions to change the driving direction of the ratchet wrench, which is time-consuming and laborsome.

Thus, a need exists for a ratchet wrench that allows easy operation in the change of the driving direction and in the slight tightness adjustment.

SUMMARY OF THE INVENTION

The present invention solves this need and other problems in the field of easy operation of wrenches by providing, in a preferred form, a ratchet wrench including a body having a head and a handle interconnected to the head. The head includes first and second sides spaced in a thickness direction. A through-hole extends from the first side through the second side of the head and includes an inner periphery having a plurality of teeth. A drive member is rotatably received in the through-hole and includes first and second ends spaced in the thickness direction. The first end of the drive member includes first and second compartments. The drive member further includes a hole extending in the thickness direction and in communication with the first and second compartments. The second end of the drive member is adapted for driving a fastener. First and second pawls are respectively and pivotably received in the first and second compartments about first and second pivot axes. Each of the first and second pawls includes first and second ends and an inner side extending between the first and second ends in a longitudinal direction perpendicular to the thickness direction. The first end of each of the first and second pawls includes a plurality of first teeth. The second end of each of the first and second pawls includes a plurality of second teeth. The inner side of each of the first and second pawls including a positioning section having first, second, and third positioning faces spaced in the longitudinal direction. The third positioning face is intermediate the first and second positioning faces. The first pawl includes a first longitudinal axis passing through the first pivot axis. The second pawl includes a second longitudinal axis passing through the second pivot axis. A first line passing through a center of the third positioning face of the first pawl and the first pivot axis is at a first acute angle with a second line passing through the first pivot axis and normal to the first longitudinal axis. A third line passing through a center of the third positioning face of the second pawl and the second pivot axis is at a second acute angle with a fourth line passing through the second pivot axis and normal to the second longitudinal axis. A control member is rotatably extended through the hole of the drive member and movable between first, second, and third operative positions. A pressing device is mounted between the control member and the first and second pawls and selectively presses against the first, second, and third positioning faces of each of the first and second pawls.

When the control member is in the first operative position, the pressing device presses against the second positioning face of the first pawl and the first positioning face of the second pawl, the second teeth of the first pawl and the first teeth of the second pawl are engaged with the teeth of the head, and the first teeth of the first pawl and the second teeth of the second pawl are disengaged from the teeth of the head, allowing the handle and the drive member to rotate in a first direction driving the fastener in the first direction, and allowing the handle to rotate freely relative to the drive member in a second direction reverse to the first direction without driving the fastener.

When the control member is in the third operative position, the pressing device presses against the first positioning face of the first pawl and the second positioning face of the second pawl, the first teeth of the first pawl and the second teeth of the second pawl are engaged with the teeth of the head, and the second teeth of the first pawl and the first teeth of the second pawl are disengaged from the teeth of the head, allowing the handle and the drive member to rotate in the second direction driving the fastener in the second direction, and allowing the handle to rotate freely relative to the drive member in the first direction without driving the fastener.

When the control member is in the second operative position, the pressing device presses against the third positioning faces of the first and second pawls, the first teeth of each of the first and second pawls are engaged with the teeth of the head, and the second teeth of each of the first and second pawls are disengaged from the teeth of the head, allowing the handle and the drive member to rotate in either of the first and second directions driving the fastener, and not allowing free rotation of the handle relative to the drive member in either of the first and second directions without driving the fastener.

In the most preferred form, the first longitudinal axis passes through centers of the first and second teeth of the first pawl, and the second longitudinal axis passes through centers of the first and second teeth of the second pawl. Furthermore, the first acute angle is equal to the second acute angle. Furthermore, the center of the third positioning face of the first pawl has a first spacing to the first end of the first pawl and a second spacing to the second end of the first pawl. The first spacing is larger than the second spacing. Further, the center of the third positioning face of the second pawl has a third spacing to the first end of the second pawl and a fourth spacing to the second end of the second pawl. The third spacing is larger than the fourth spacing.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
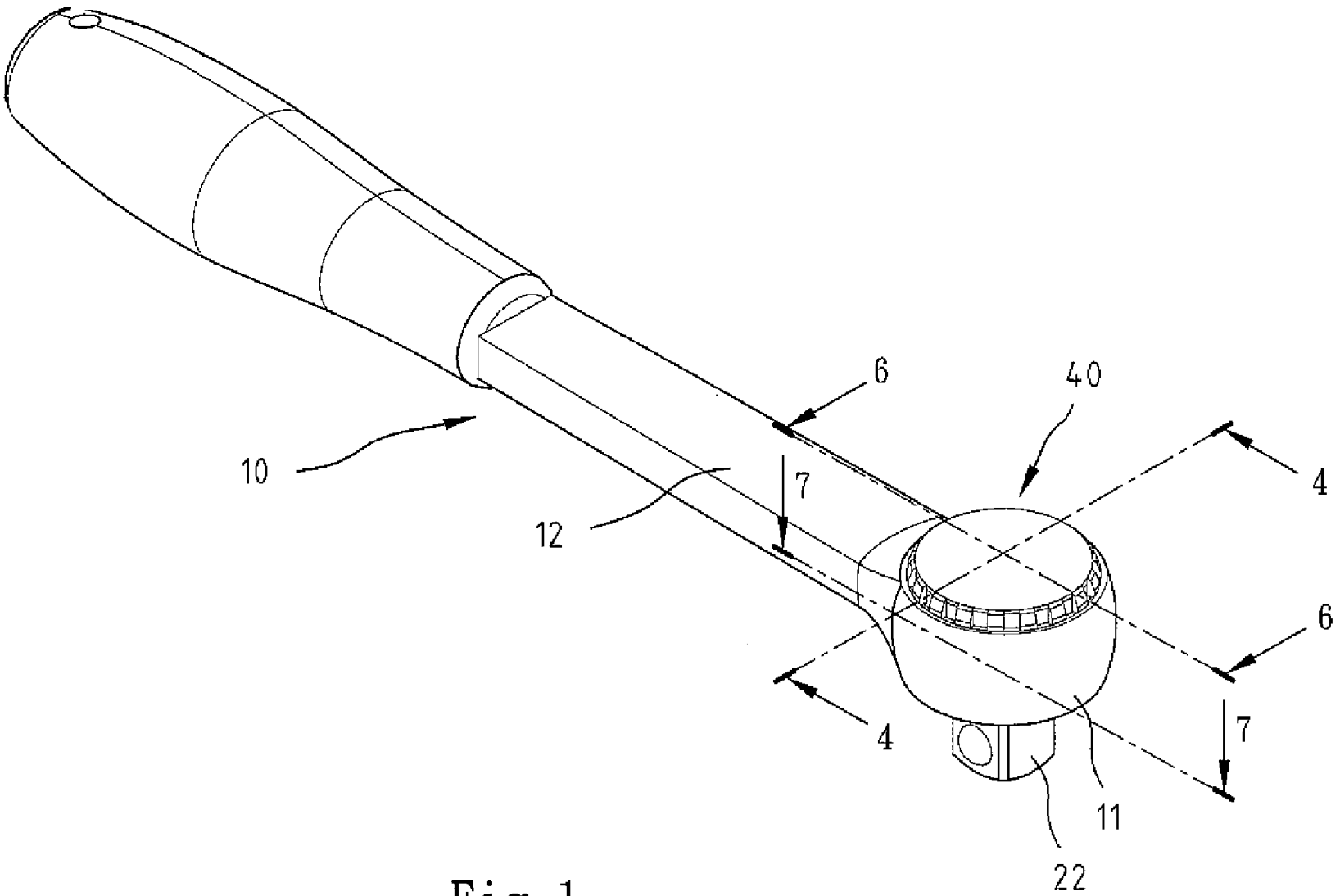
FIG. 1 shows a perspective view of a ratchet wrench according to the preferred teachings of the present invention.
Figure 2:
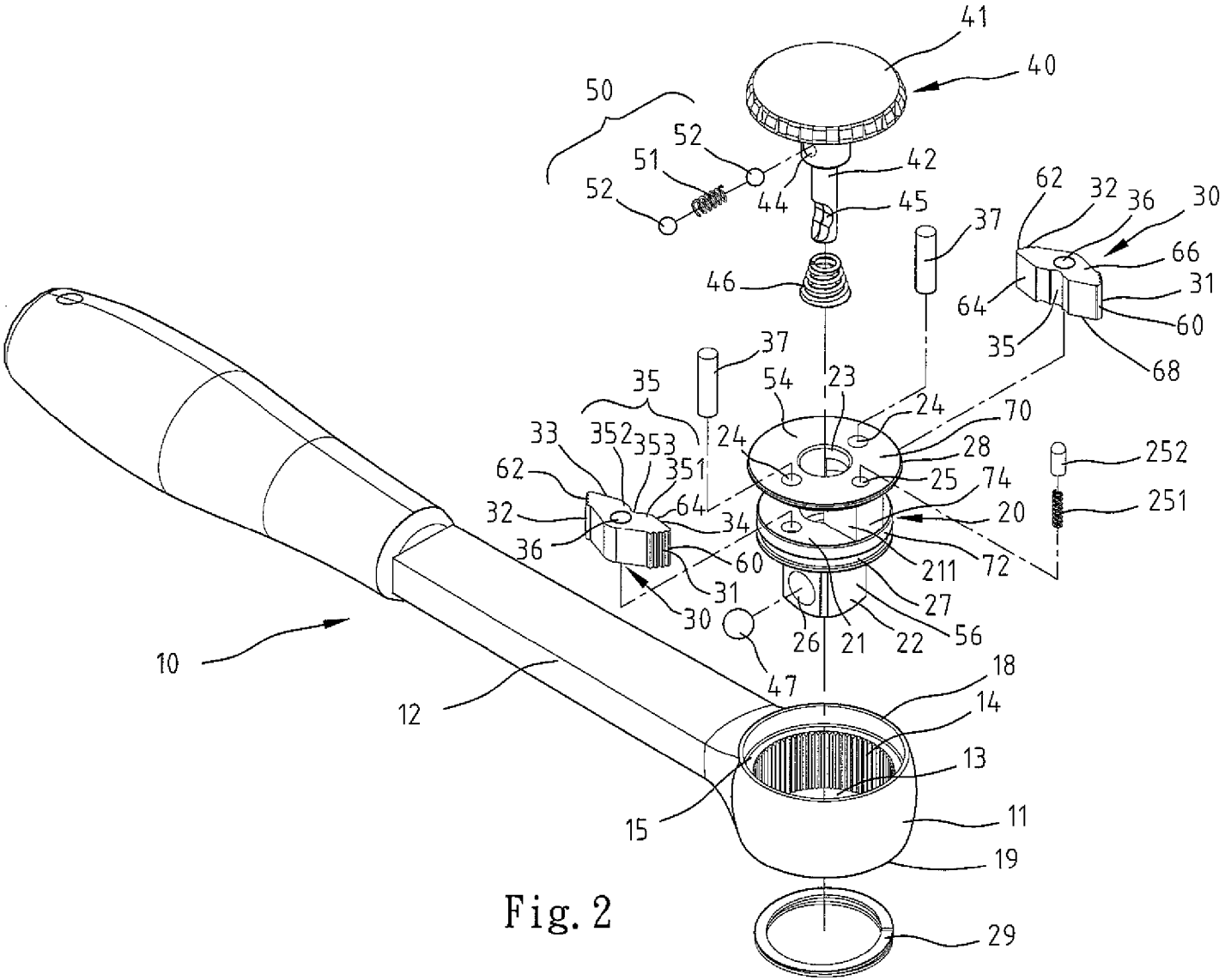
FIG. 2 shows an exploded, perspective view of the ratchet wrench of FIG. 1.
Figure 3:
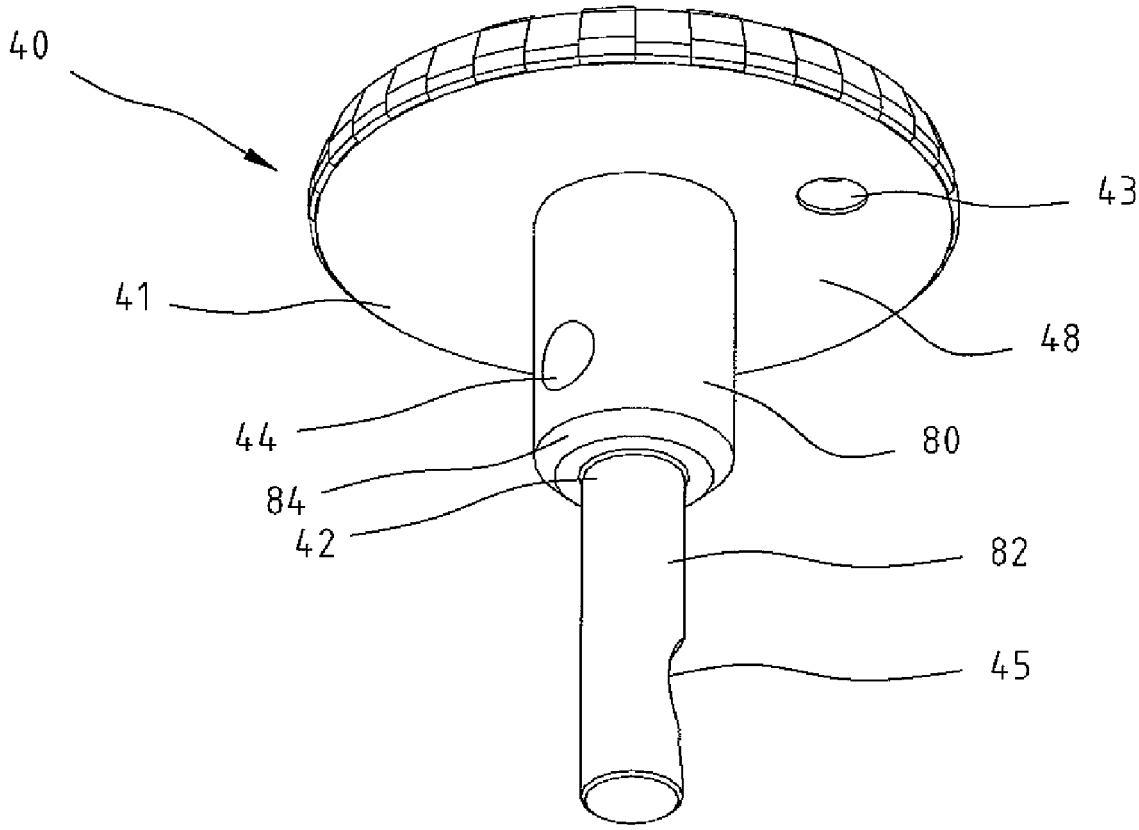
FIG. 3 shows a bottom, perspective view of a control member of the ratchet wrench of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "annular", "radial", "longitudinal", "clockwise", "counterclockwise", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

A ratchet wrench according to the preferred teachings of the present invention is shown in the drawings and generally includes a body 10 having a head 11 and a handle 12 interconnected to head 11. Head 11 includes circular cross sections and first and second sides 18 and 19 spaced in a thickness direction. Head 11 further includes a through-hole 13 extending from first side 18 through second side 19. Through-hole 13 includes an inner periphery having a plurality of teeth 14 extending in the thickness direction. According to the most preferred form shown, the inner periphery of through-hole 13 includes a shoulder 15 adjacent first side 18. A compartment 90 is defined between shoulder 15 and first side 18.

According to the preferred form shown, a drive member 20 is rotatably received in through-hole 13. Drive member 20 includes first and second ends 54 and 56 spaced in the thickness direction. First end 54 includes first and second boards 70 and 72 spaced in the thickness direction and an interconnecting wall 74 interconnected between first and second boards 70 and 72. First board 70 includes a flange 28 on an outer periphery thereof. Flange 28 rotatably abuts shoulder 15 of head 11. Second board 72 includes an annular groove 27 in an outer periphery thereof. A retainer ring 29 in the most preferred form shown as a C-clip is partially received in annular groove 27 and abuts second side 19 of bead 11, allowing rotation of drive member 20 relative to head 11 while retaining drive member 20 in head 11. First end 54 of drive member 54 further includes first and second compartments 21 between first and second boards 70 and 72. First end 54 of drive member 20 further includes a hole 23 extending from first end 54 into second end 56 and intermediate and in communication with first and second compartments 21. Thus, first and second compartments 21 are in communication with each other via hole 21. First and second boards 70 and 72 include two aligned first pivot holes 24 in communication with first compartment 21. First and second boards 70 and 72 further includes two aligned second pivot holes 24 diametrically opposite to first pivot holes 24 and in communication with second compartment 21. A positioning hole 25 extends through first board 70 into interconnecting wall 74 in the thickness direction. An angular spacing between positioning hole 25 and first pivot holes 24 is equal to that between positioning hole 25 and second pivot holes 24. A pin 252 and a spring 251 are received in positioning hole 25. In the most preferred form shown, hole 23 includes a stepped portion 86 in second board 72. In the most preferred form shown, second end 56 of drive member 20 is in the form of a drive column 22 located outside of head 11 and having square cross sections. Second end 56 of drive member 20 includes a transverse hole 26 receiving a ball 47 and in communication with hole 23. Drive column 22 can be releasably coupled with a socket for driving a fastener. Other forms of second end 56 of drive member 20 for directly or indirectly engaging with a fastener to be loosened or tightened would be within the skill of the art.

According to the preferred form shown, first and second pawls 30 are respectively and pivotably received in first and second compartments 21 about first and second pivot axes O. Each of first and second pawls 30 includes first and second ends 60 and 62 and an inner side 64 extending between first and second sides 60 and 62 in a longitudinal direction perpendicular to the thickness direction. First end 60 of each of first and second pawls 30 includes a plurality of first teeth 31. Second end 62 of each of first and second pawls 30 includes a plurality of second teeth 32. Inner side 64 of each of first and second pawls 30 includes a first wall section 34 adjacent first end 60, a second wall section 33 adjacent second end 62, and a positioning section 35 intermediate first and second wall sections 34 and 33. Positioning section 35 of each of first and second pawls 30 includes first second, and third positioning faces 351, 352, and 353 spaced in the longitudinal direction. Each of first and second positioning faces 351 and 352 are planar. Third positioning face 353 is arcuate and intermediate first and second positioning face 351 and 352. Handle 12 has a spacing to first positioning face 351 of each of first and second pawls 30 larger than third positioning face 353 of each of first and second pawls 30. Each of first and second pawls 30 further includes upper and lower faces 66 and 68 spaced in the thickness direction and a pin hole 36 extending from upper face 66 through lower face 68. A first pin 37 is extended through first pivot holes 24 and pin hole 36 of first pawl 30 and defines first pivot axis O about which first pawl 30 is pivotable. A second pin 37 is extended through second pivot holes 24 and pin hole 36 of second pawl 30 and defines second pivot axis O about which second pawl 30 is pivotable.

In the most preferred form shown, first pawl 30 includes a first longitudinal axis L passing through first pivot axis O and first and second teeth 31 and 32 of first pawl 30, and second pawl 30 includes a second longitudinal axis L passing through second pivot axis O and first and second teeth 31 and 32 of second pawl 30. A first line S passing through a center C of third positioning face 353 of first pawl 30 and first pivot axis O is at a first acute angle A with a second line E passing through first pivot axis O and normal to first longitudinal axis L. Furthermore, a third line S passing through a center C of third positioning face 353 of second pawl 30 and second pivot axis O is at a second acute angle B with a fourth line E passing through second pivot axis O and normal to second longitudinal axis L. First acute angle A is equal to second acute angle B. Center C of third positioning face 353 of first pawl 30 has a first spacing to first end 60 of first pawl 30 and a second spacing to second end 62 of first pawl 30. Center C of third positioning face 353 of second pawl 30 has a third spacing to first end 60 of second pawl 30 and a second spacing to second end 62 of second pawl 30. The first spacing is larger than the second spacing, and the third spacing is larger than the fourth spacing. Namely, center C of third positioning face 353 of each of first and second pawls 30 is not coincident to the center of inner side 64.

Figure 4:
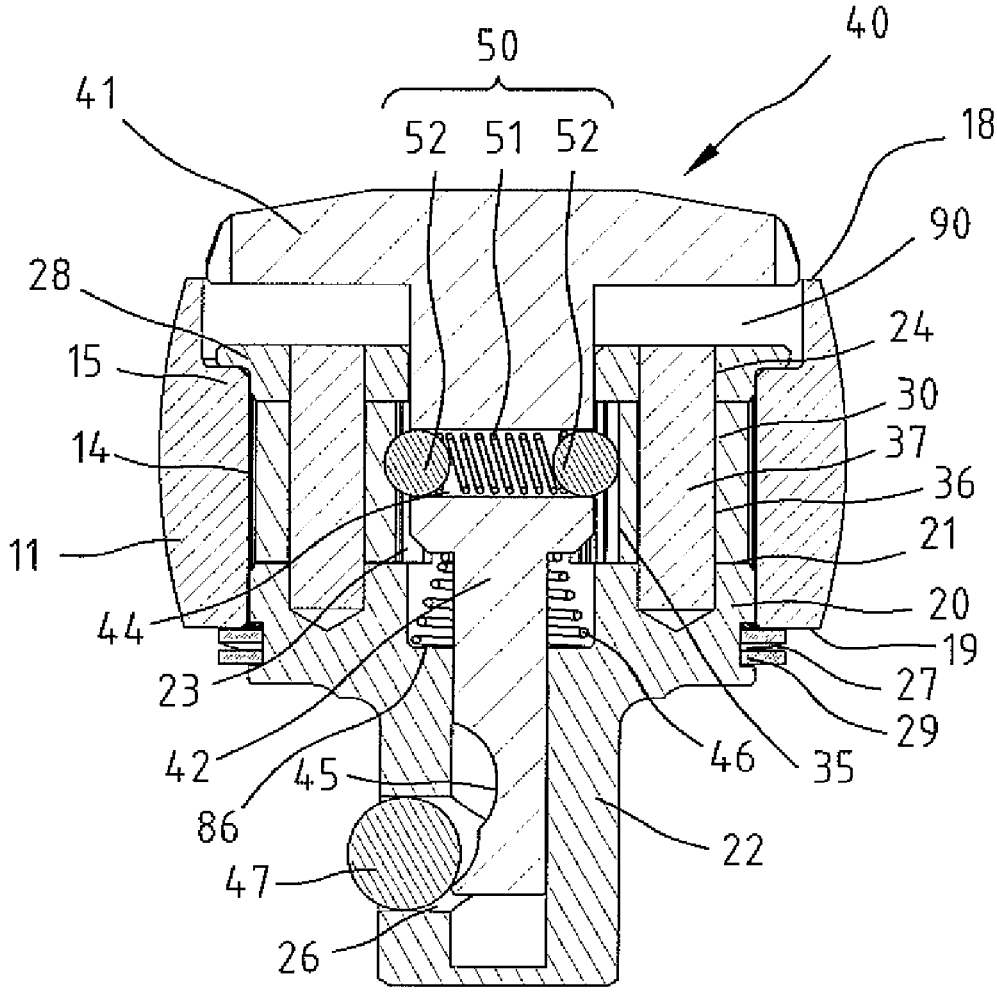
FIG. 4 shows a cross sectional view of the ratchet wrench of FIG. 1 according to section line 4-4 of FIG. 1.
Figure 5:
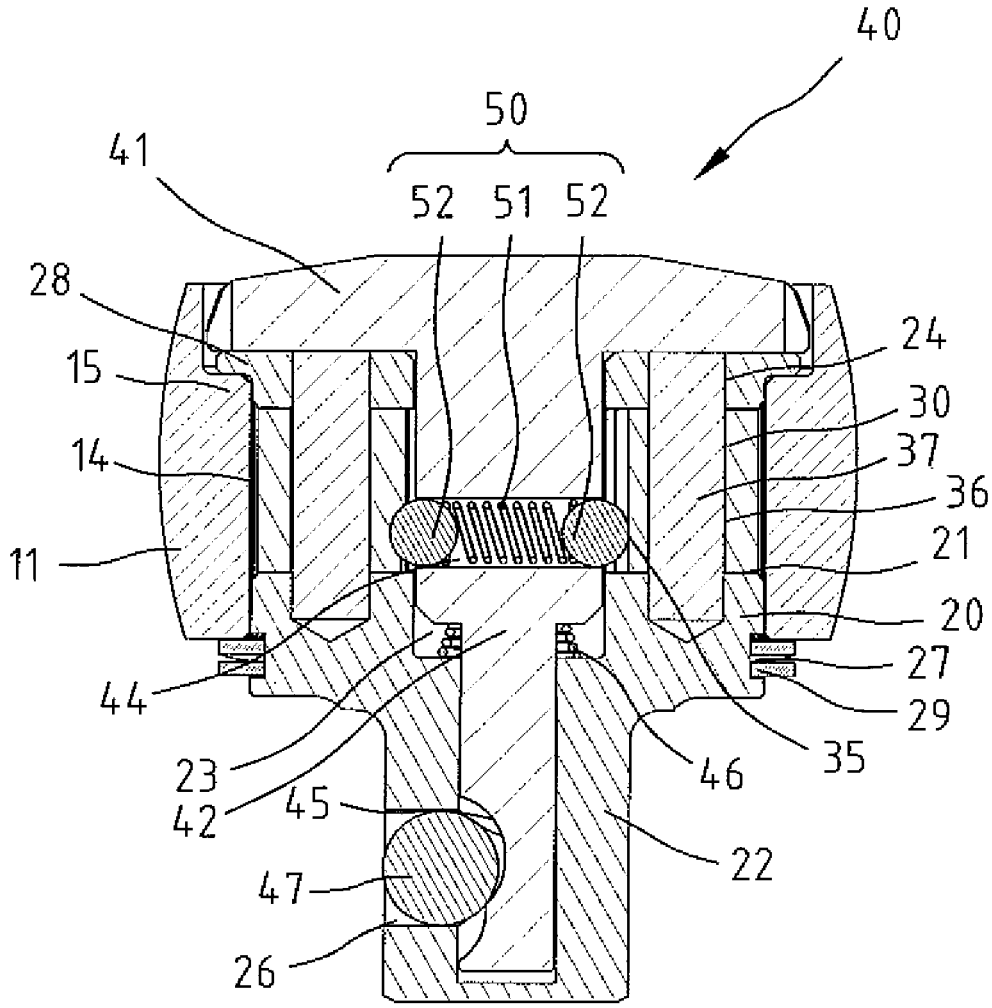
FIG. 5 is a view similar to FIG. 4 with the control member pressed.

According to the preferred form shown, the ratchet wrench further includes a control member 40 including a disc 41 having a face 48 with a recess 43. Control member 40 further includes a stem 42 extending from face 48 in the thickness direction and spaced from recess 43. Stem 42 is rotatably extended through hole 23 of drive member 20. Disc 41 includes a frictional outer periphery allowing a user to manually move stem 42 between first, second, and third operative positions. Stem 42 includes a larger section 80 adjacent stem 42 and a smaller section 82 distant to stem 42. Larger section 80 includes a radial through-hole 44 having a longitudinal axis X extending in a radial direction perpendicular to the thickness direction. Smaller section 82 is received in a lower portion of hole 23 and includes a stepped groove 45. Larger section 80 is received in an upper portion of hole 23, and a spring 46 is mounted between an end face 84 of larger section 80 and stepped portion 86 of hole 23. Spring 46 biases stem 42 to a position such that ball 47 is pushed out of hole 23 by a bottom wall of stepped groove 45 (FIG. 4), allowing secure coupling between driving column 22 and a socket. When stem 42 is pressed in the thickness direction into compartment 90, spring 46 is compressed, and stem 42 is moved to a position so that ball 47 can be received in stepped groove 45 (FIG. 5), allowing engagement or disengagement of the socket with or from driving column 22.

According to the preferred form shown, the ratchet wrench further includes a pressing device 50 for retaining first and second pawls 30 in place. Pressing device 50 is received in radial through-hole 44 and includes first and second pressing members 52 in the most preferred form shown as two balls and an elastic element 51 in the most preferred form shown as a spring. Elastic element 51 biases first and second pressing members 52 to partially protrude out of radial through-hole 44.

Figure 6:
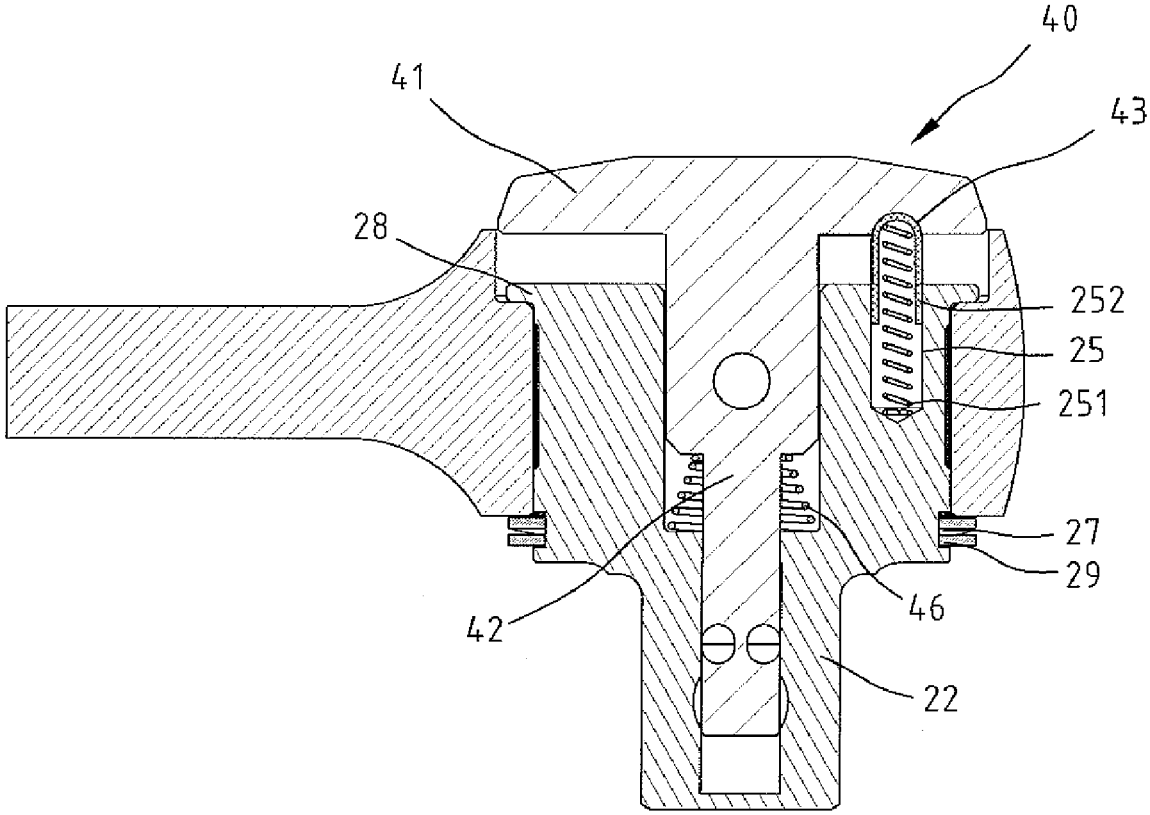
FIG. 6 shows a partial, cross sectional view of the ratchet wrench of FIG. 1 according to section line 6-6 of FIG. 1 with the control member in a second operative position.
Figure 7:
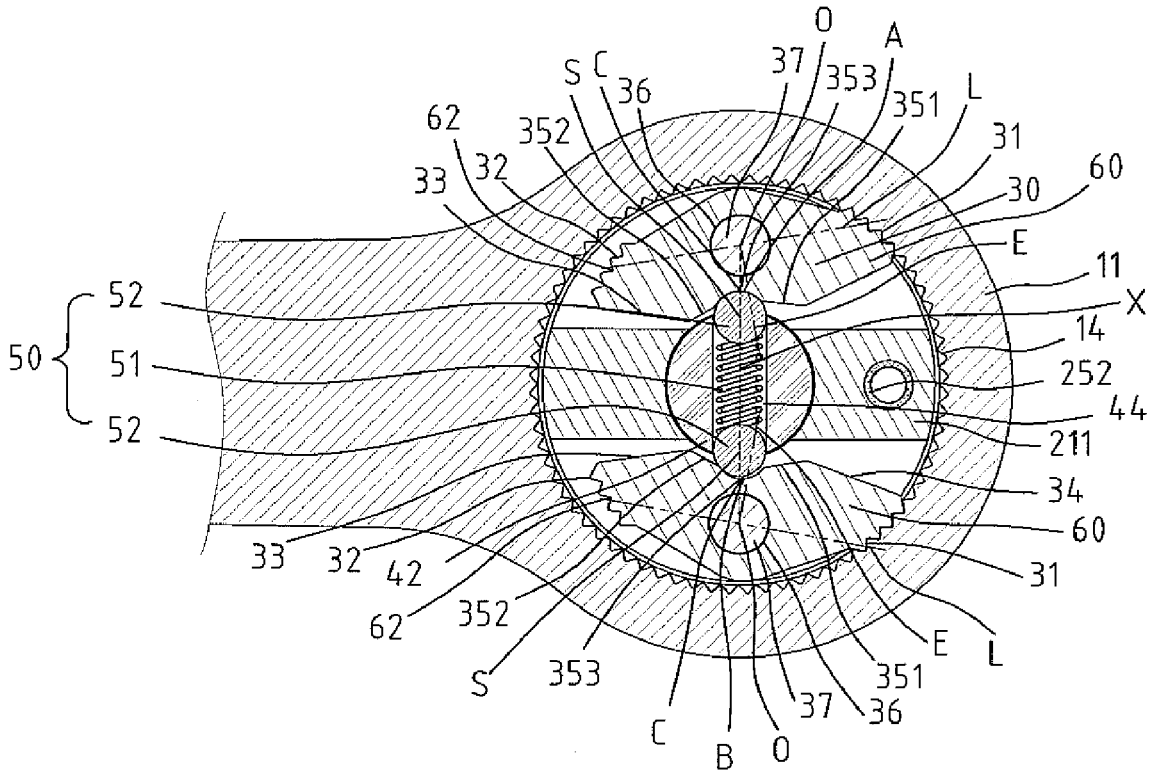
FIG. 7 shows a partial, cross sectional view of the ratchet wrench of FIG. 1 according to section line 7-7 of FIG. 1 with the control member in the second operative position.

Now that the basic construction of the ratchet wrench of the preferred teachings of the present invention has been explained, the operation and some of the advantages of the ratchet wrench can be set forth and appreciated. In particular, for the sake of explanation, it will be assumed that control member 40 is initially in the second operative position (FIG. 7) intermediate the first and third operative positions. Pin 252 is biased by spring 251 into recess 43 of control member 40 (FIG. 6). First pressing member 52 presses against third positioning face 353 of first pawl 30 under the action of elastic element 51. Second pressing member 52 presses against third pressing face 353 of second pawl 30 under the action of elastic element 51. Since center C of third positioning face 353 of each of first and second pawls 30 is not coincident to the center of inner side 64, first and second pawls 30 are pivoted to a position such that first teeth 31 of first and second pawls 30 are engaged with teeth 14 of head 11 and that second teeth 32 of first and second pawls 30 are engaged with teeth 14 of head 11. Thus, handle 12 and drive member 20 can rotate in either of clockwise and counterclockwise directions to drive a fastener in the same direction. Free rotation of handle 12 relative to drive member 20 in either direction without driving the fastener is not allowed. Thus, the ratchet wrench according to the preferred teachings of the present invention can be utilized to perform slight tightness adjustment of the fastener when control member 40 is in the second operative position. Note that first and third lines S are coincident to longitudinal axis X of radial hole 44 of stem 42 when control member 40 is in the second operative position.

Figure 8:
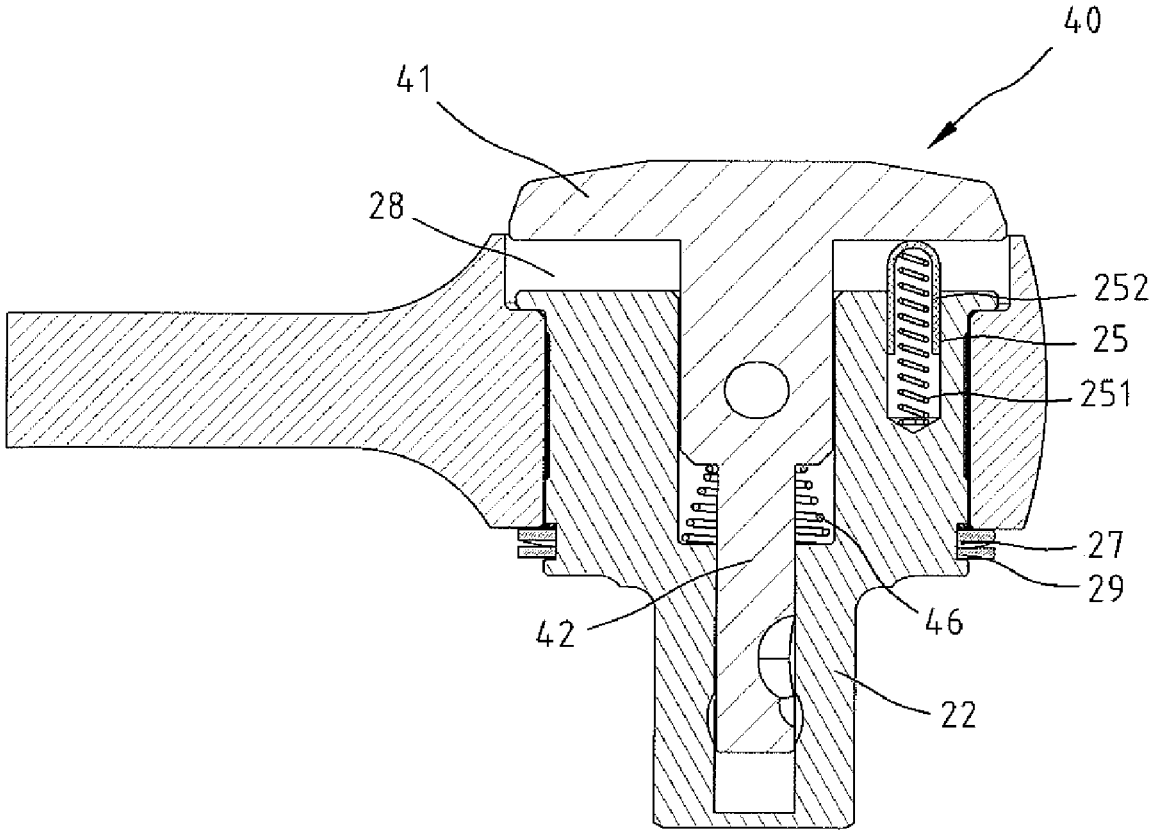
FIG. 8 is a view similar to FIG. 6, wherein the control member is in a first operative position.
Figure 9:
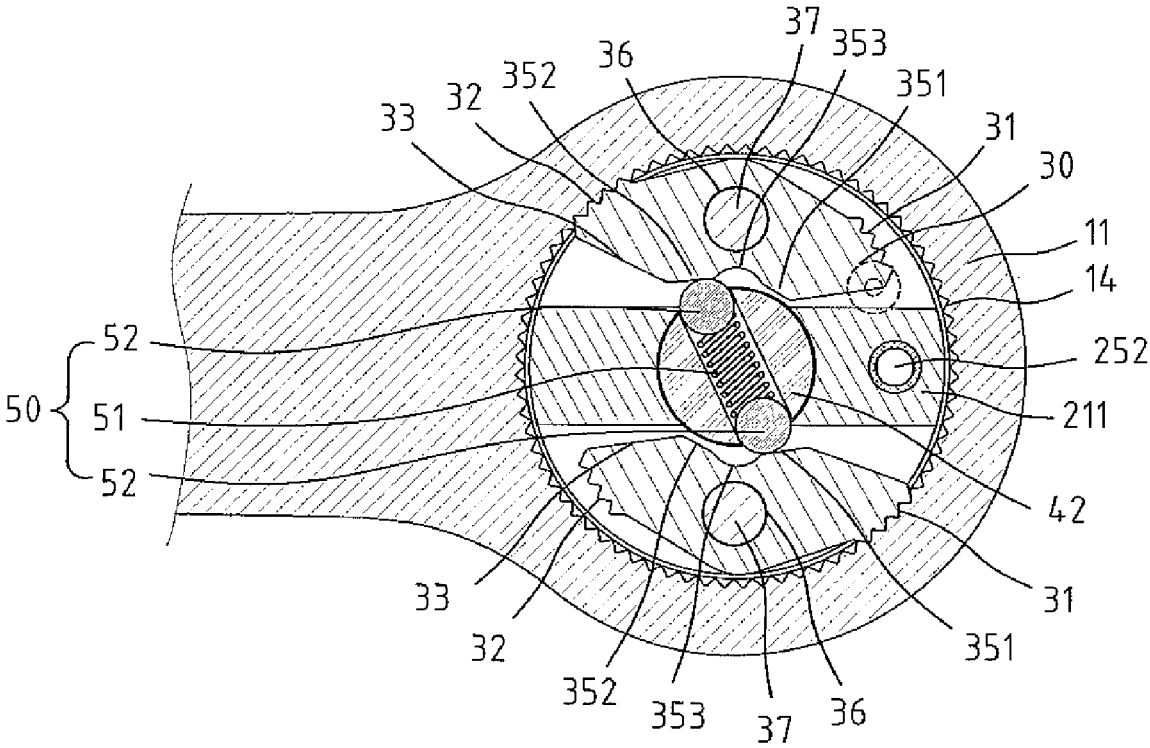
FIG. 9 is a view similar to FIG. 7, wherein the control member in the first operative position.

When the control member 40 is moved from the second operative position to the first operative position (FIG. 9), first pressing member 52 presses against second positioning face 352 of first pawl 30, and second pressing member 52 presses against first pressing face 351 of second pawl 30. Pin 252 is disengaged from recess 43 of control member 40 (FIG. 8). First teeth 31 of first pawl 30 and second teeth 32 of second pawl 30 are disengaged from teeth 14 of head 11. Furthermore, second teeth 32 of first pawl 30 and first teeth 31 of second pawl 30 are engaged with teeth 14 of head 11. In this state, handle 12 and drive member 20 can rotate in the clockwise direction to drive the fastener in the clockwise direction. Furthermore, handle 12 can rotate freely relative to drive member 20 in the counterclockwise direction without driving the fastener.

Figure 10:
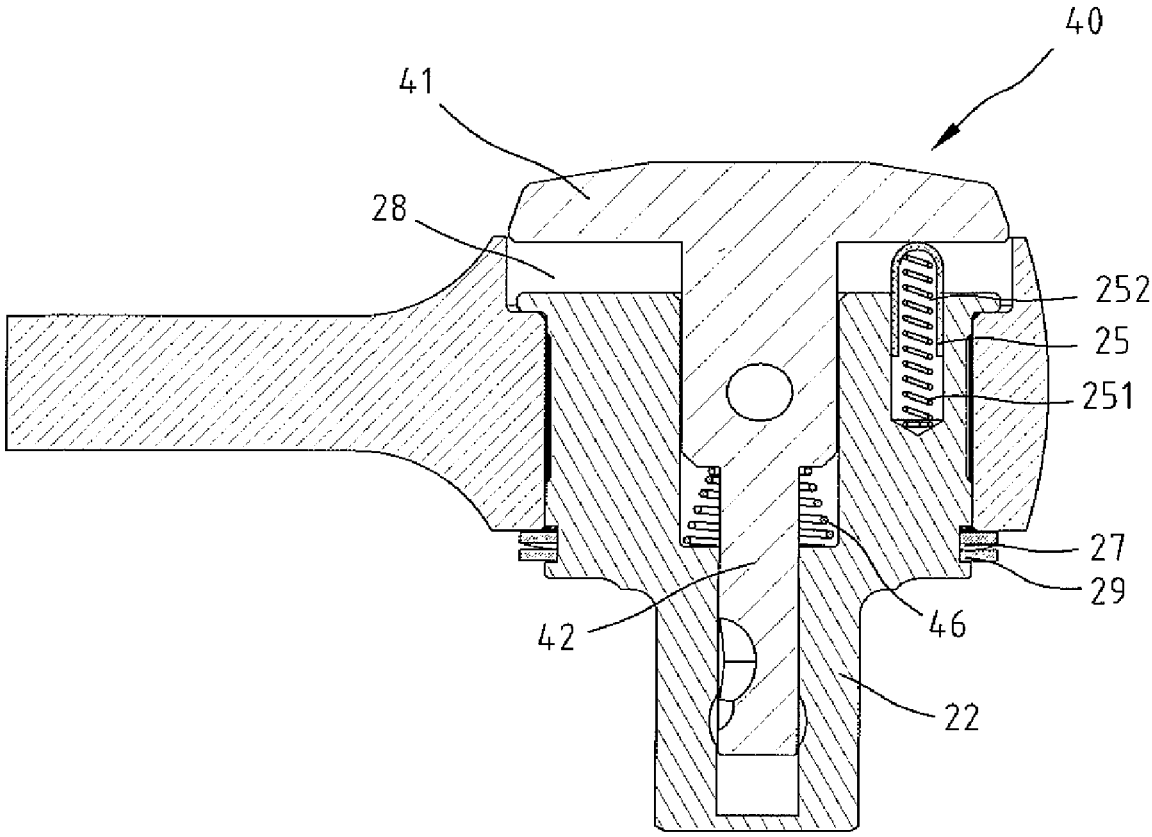
FIG. 10 is a view similar to FIG. 6, wherein the control member is in a third operative position.
Figure 11:
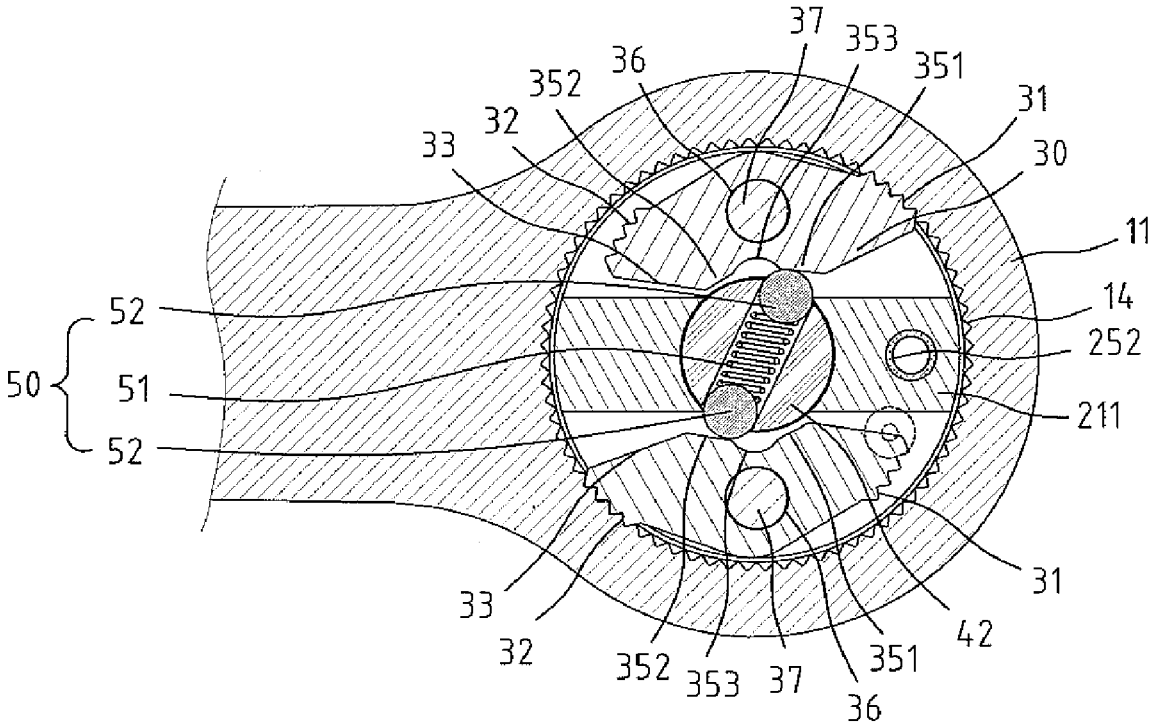
FIG. 11 is a view similar to FIG. 7, wherein the control member in the third operative position.

When the control member 40 is moved from the second operative position to the third operative position (FIG. 11), first pressing member 52 presses against first positioning face 351 of first pawl 30, and second pressing member 52 presses against second pressing face 352 of second pawl 30. Pin 252 is disengaged from recess 43 of control member 40 (FIG. 10). First teeth 31 of first pawl 30 and second teeth 32 of second pawl 30 are engaged with teeth 14 of head 11. Furthermore, second teeth 32 of first pawl 30 and first teeth 31 of second pawl 30 are disengaged from teeth 14 of head 11. In this state, handle 12 and drive member 20 can rotate in the counterclockwise direction to drive the fastener in the counterclockwise direction. Furthermore, handle 12 can rotate freely relative to drive member 20 in the clockwise direction without driving the fastener.

Now that the basic teachings of the present invention have been explained, many extensions and variations will be obvious to one having ordinary skill in the art. For example, control member 40 can include a tail piece extending from disc 41 allowing the user to grip and move control member 40 between the first, second, and third operative positions. Furthermore, a wall can be formed in radial through-hole 44 of stem 42 to separate it into two receptacles each receiving a pressing member and an elastic element.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising:

a body (10) including a head (11) and a handle (12) interconnected to the head (11), with the head (11) including first and second sides (18, 19) spaced in a thickness direction, with the head (11) further including a through-hole (13) extending from the first side (18) through the second side (19), with the through-hole (13) including an inner periphery having a plurality of teeth (14);

a drive member (20) rotatably received in the through-hole (13), with the drive member (20) including first and second ends (54, 56) spaced in the thickness direction, with the first end (54) of the drive member (20) including first and second compartments (21), with the drive member (20) further including a hole (23) extending in the thickness direction and in communication with the first and second compartments (21), with the second end (56) of the drive member (20) being adapted for driving a fastener;

first and second pawls (30) respectively and pivotably received in the first and second compartments (21) about first and second pivot axes (O), with each of the first and second pawls (30) including first and second ends (60, 62) and an inner side (64) extending between the first and second ends (60, 62) in a longitudinal direction perpendicular to the thickness direction, with the first end (60) of each of the first and second pawls (30) including a plurality of first teeth (31), with the second end (62) of each of the first and second pawls (30) including a plurality of second teeth (32), with the inner side (64) of each of the first and second pawls (30) including a positioning section (35) having first, second, and third positioning faces (351, 352, 353) spaced in the longitudinal direction, with the third positioning face (353) intermediate the first and second positioning faces (351, 352), with the first pawl (30) including a first longitudinal axis (L) passing through the first pivot axis (O), with the second pawl (30) including a second longitudinal axis (L) passing through the second pivot axis (O), with a first line (S) passing through a center (C) of the third positioning face (353) of the first pawl (30) and the first pivot axis (O) being at a first acute angle (A) with a second line (E) passing through the first pivot axis (O) and normal to the first longitudinal axis (L), with a third line (S) passing through a center (C) of the third positioning face (353) of the second pawl (30) and the second pivot axis (O) being at a second acute angle (B) with a fourth line (E) passing through the second pivot axis (O) and normal to the second longitudinal axis (L);

a control member (40) rotatably extending through the hole (23) of the drive member (20) and movable between first, second, and third operative positions; and a pressing device (50) mounted between the control member (40) and the first and second pawls (30) and selectively pressing against the first, second, and third positioning faces (351, 352, 353) of each of the first and second pawls (30), wherein when the control member (40) is in the first operative position, the pressing device (50) presses against the second positioning face (352) of the first pawl (30) and the first positioning face (351) of the second pawl (30), the plurality of second teeth (32) of the first pawl (30) and the plurality of first teeth (31) of the second pawl (30) are engaged with the plurality of teeth (14) of the head (11), and the plurality of first teeth (31) of the first pawl (30) and the plurality of second teeth (33) of the second pawl (30) are disengaged from the plurality of teeth (14) of the head (11), allowing the handle (12) and the drive member (20) to rotate in a first direction driving the fastener in the first direction, and allowing the handle (12) to rotate freely relative to the drive member (20) in a second direction reverse to the first direction without driving the fastener, wherein when the control member (40) is in the third operative position, the pressing device (50) presses against the first positioning face (351) of the first pawl (30) and the second positioning face (352) of the second pawl (30), the plurality of first teeth (31) of the first pawl (30) and the plurality of second teeth (32) of the second pawl (30) are engaged with the plurality of teeth (14) of the head (11), and the plurality of second teeth (32) of the first pawl (30) and the plurality of first teeth (31) of the second pawl (30) are disengaged from the plurality of teeth (14) of the head (11), allowing the handle (12) and the drive member (20) to rotate in the second direction driving the fastener in the second direction, and allowing the handle (12) to rotate freely relative to the drive member (20) in the first direction without driving the fastener, and wherein when the control member (40) is in the second operative position, the pressing device (50) presses against the third positioning faces (353) of the first and second pawls (30), the plurality of first teeth (31) of each of the first and second pawls (30) are engaged with the plurality of teeth (14) of the head (11), and the plurality of second teeth (32) of each of the first and second pawls (30) are disengaged from the plurality of teeth (14) of the head (11), allowing the handle (12) and the drive member (20) to rotate in either of the first and second directions driving the fastener, and not allowing free rotation of the handle (12) relative to the drive member (20) in either of the first and second directions without driving the fastener.

2. The ratchet wrench as claimed in claim 1, with the first longitudinal axis (L) passing through centers of the first and second teeth (31, 32) of the first pawl (30), with the second longitudinal axis (L) passing through centers of the first and second teeth (31, 32) of the second pawl (30), and with the first acute angle (A) equal to the second acute angle (B).

3. The ratchet wrench as claimed in claim 2, with the handle (12) having a spacing to the first positioning face (351) of each of the first and second pawls (30) larger than the third positioning face (353) of each of the first and second pawls (30), with the center (C) of the third positioning face (353) of the first pawl (30) having a first spacing to the first end (60) of the first pawl (30) and a second spacing to the second end (62) of the first pawl (30), with the first spacing larger than the second spacing, with the center (C) of the third positioning face (353) of the second pawl (30) having a third spacing to the first end (60) of the second pawl (30) and a fourth spacing to the second end (62) of the second pawl (30), and with the third spacing larger than the fourth spacing.

4. The ratchet wrench as claimed in claim 1, with the control member (40) including a disc (41) having a face (48) with a recess (43), with the control member (40) further including a stem (42) extending from the face (48) of the disc (41) in the thickness direction, with the stem (42) rotatably extending through the hole (23) of the drive member (20) and spaced from the recess (43), with the first end (54) of the drive member (20) further including a positioning hole (25) extending in the thickness direction and spaced from the hole (23), with a pin (252) and a spring (251) being received in the positioning hole (25), and with the pin (252) being biased by the spring (251) into the recess (43) when the control member (40) is in the second operative position.

5. The ratchet wrench as claimed in claim 4, with the stem (42) including a radial through-hole (44) extending in a radial direction perpendicular to the thickness direction, with the pressing device (50) received in the radial through-hole (44) and including first and second pressing members (52) and an elastic element (51) mounted between the first and second pressing members (52), and with each of the first and second pressing members (52) being biased by the elastic element (51) to press against one of the first, second, and third positioning faces (351, 352, 353) of one of the first and second pawls (30) corresponding to one of the first, second, and third operative positions of the control member (40).

6. The ratchet wrench as claimed in claim 5, with the first end (50) of the drive member (20) including first and second boards (70, 72) spaced in the thickness direction and an interconnecting wall (74) interconnected between the first and second boards (70, 72), with the positioning hole (25) extending through the first board (70) into the interconnecting wall (74), with the first board (70) including a flange (28) on an outer periphery thereof, with the inner periphery of the through-hole (13) of the head (11) including a shoulder (15), and with the flange (28) rotatably abutting the shoulder (15).

7. The ratchet wrench as claimed in claim 6, with the first and second boards (70, 72) including two aligned first pivot holes (24) and two aligned second pivot holes (24) diametrically opposite to the two first pivot holes (24), with the first pawl (30) including a first pin hole (36) aligned with the two first pivot holes (24), with a first pin (37) extending through the first pin hole (36) and the two first pivot holes (24) and defining the first pivot axis (O), with the second pawl (30) including a second pin hole (36) aligned with the two second pivot holes (24), and with a second pin (37) extending through the second pin hole (36) and the two second pivot holes (24) and defining the second pivot axis (O).

8. The ratchet wrench as claimed in claim 7, with the radial through-hole (44) including a longitudinal axis (X) extending in the radial direction, and with the first and third lines (S) coincident to the longitudinal axis (X) of the radial through-hole (44) when the control member (40) is in the second operative position.

9. The ratchet wrench as claimed in claim 7, with the first and second positioning faces (351 and 352) of each of the first and second pawls (30) being planar, and with the third positioning face (353) of each of the first and second pawls (30) being arcuate.

10. The ratchet wrench as claimed in claim 1, with the control member (40) including a radial through-hole (44) extending in a radial direction perpendicular to the thickness direction, with the pressing device (50) received in radial the through-hole (44) and including first and second pressing members (52) and an elastic element (51) mounted between the first and second pressing members (52), and with each of the first and second pressing members (52) being biased by the elastic element (51) to press against one of the first, second, and third positioning faces (351, 352, 353) of one of the first and second pawls (30) corresponding to one of the first, second, and third operative positions of the control member (40).

11. The ratchet wrench as claimed in claim 10, with the radial through-hole (44) including a longitudinal axis (X) extending in the radial direction, and with the first and third lines (S) coincident to the longitudinal axis (X) of the radial through-hole (44) when the control member (40) is in the second operative position.

* * * * *